United States Patent [19]

Grafen et al.

[11] Patent Number: 4,780,965

[45] Date of Patent: Nov. 1, 1988

[54] METHOD FOR THE THERMAL CLEANING OF EXHAUST GASES OF A HEAT TREATMENT APPARATUS

[75] Inventors: Karl Grafen, Wuerselen; Gerhard Golkowsky, Willich; Helmut Paulus, Herzogenrath, all of Fed. Rep. of Germany

[73] Assignee: H. Krantz GmbH & Co., Aachen, Fed. Rep. of Germany

[21] Appl. No.: 49,610

[22] Filed: May 13, 1987

[30] Foreign Application Priority Data

May 15, 1986 [DE] Fed. Rep. of Germany ..... 3616333

[51] Int. Cl.[4] ..... F26B 3/04

[52] U.S. Cl. ..... 34/35; 34/86; 34/32; 34/79

[58] Field of Search ..... 34/35, 86, 39, 41, 79, 34/32

[56] References Cited

U.S. PATENT DOCUMENTS 4,231,165 11/1980 Gresens et al. ..... 34/86

*Primary Examiner*—Larry I. Schwartz

*Attorney, Agent, or Firm*—W. G. Fasse; D. H. Kane, Jr.

[57] ABSTRACT

Exhaust gases from a heat treatment device operated by a gaseous treatment medium, are cleaned by oxidizing the combustible components of the medium. The exhaust gases already cleaned are used in a first heat exchanger for preheating the gases to be cleaned. The cleaned and heated exhaust gases are then passed through a second heat exchanger for heating a heat carrier medium in a first closed heat carrier circuit connected to the treatment device. The exhaust gases coming from the second heat exchanger are supplied to a third heat exchanger connected to a fourth heat exchanger by a second closed heat carrier circuit for transferring heat to a second carrier medium for heating freshly supplied treatment medium in said fourth heat exchanger.

5 Claims, 1 Drawing Sheet

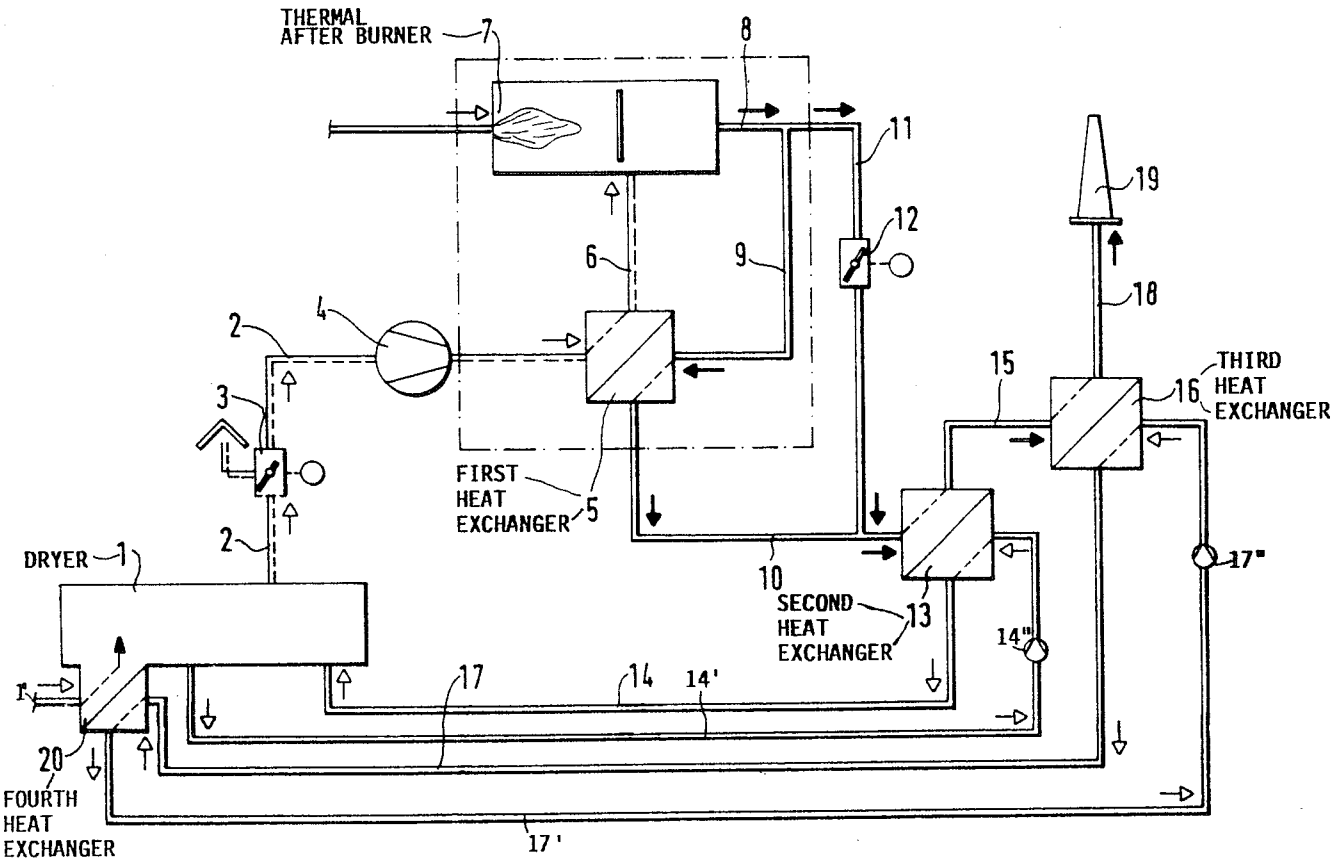
THIRD HEAT EXCHANGER
16
17"
19
18
15
14"
13
SECOND HEAT EXCHANGER
11
12
10
8
9
14'
14
6
5
FIRST HEAT EXCHANGER
17'
7
THERMAL AFTER BURNER
17
4
2
3
2
DRYER
1
20
FOURTH HEAT EXCHANGER

METHOD FOR THE THERMAL CLEANING OF EXHAUST GASES OF A HEAT TREATMENT APPARATUS

FIELD OF THE INVENTION

The invention relates to a method for the thermal cleaning of the exhaust gases discharged by a heat treatment chamber operated by a gaseous treatment medium, whereby the cleaning takes place by oxidizing the combustible components of the exhaust gases.

DESCRIPTION OF THE PRIOR ART

Methods of the just mentioned type are generally known. For example, the exhaust air coming from a tentering frame or dryer for the treatment of textile webs, are subjected to an afterburning, whereby the exhaust air is heated to a temperature of about 750° C. Thus, heated exhaust gases are generated which are caused to flow through a so-called recuperator constructed as a heat exchanger. The recuperator is used for preheating the exhaust air coming from the tentering frame or dryer by the heat recovered in the recuperator. Downstream of the recuperator the cleaned exhaust gases flow through a second heat exchanger in which heat is transferred to the circulating treatment air flowing through a first heat carrier circuit connecting the second heat exchanger with the heat exchangers installed inside the tentering frame or dryer.

Since the exhaust gases leaving the second heat exchanger still have a large heat content, it is also known to use this large heat content for heating up the fresh air that must be supplied to the tentering frame or dryer. Generally, the cleaned exhaust gases cannot be supplied directly to the tentering frame or dryer because the moisture content of the cleaned gases is too high so that the water evaporation within the tentering frame or dryer would be adversely affected. On the other hand, when the fresh air supply is directly heated in a heat exchanger and then supplied to the tentering frame or dryer, it is disadvantageous that large and expensive heat exchangers are needed for this purpose. Additionally, directly heating the fresh air supply requires large diameter heat insulated ducts or conduits to supply the fresh air to the tentering frame or dryer. Such ducts are expensive.

OBJECTS OF THE INVENTION

In view of the foregoing it is the aim of the invention to achieve the following objects singly or in combination:

to provide a method for the thermal cleaning of the exhaust gases coming from a heat treatment apparatus operating with a gaseous treatment medium to thereby use the heat content of the exhaust gases to a larger extent than was possible heretofore;

to avoid a larger expense for the exhaust gas cleaning apparatus especially with regard to large diameter and long, heat insulated fluid flow channels or ducts; and to utilize any sensible heat and latent remainder heat of the cleaned exhaust gases, for example, for heating water.

SUMMARY OF THE INVENTION

According to the invention prior art systems are improved by guiding the exhaust gases coming from the second heat exchanger, through a third heat exchanger for heating up the fresh air or other treatment medium that is being supplied to the heat treatment apparatus, and to assure a heat transfer from the third heat exchanger to the fresh treatment medium by means of a second heat carrier circuit flow which is connected with a fourth heat exchanger in which the fresh treatment medium is heated up.

The invention makes sure that the heat content of the exhaust gases is utilized more efficiently while simultaneously large and hence expensive heat exchangers as well as large diameter insulated fluid flow channels are avoided. For example, the invention can use socalled thermal oil, water or steam as a heat carrier medium in the second heat carrier circuit flow. Such a heat carrier medium heated up in the third heat exchanger, is capable to efficiently transport heat through insulated smaller diameter pipelines to the fourth heat exchanger. The fresh air supply ducts of a tentering frame or dryer are installed so that they pass through the fourth heat exchanger which thus transfers the heat to the fresh air supply.

The present method is especially suitable for tentering frames or dryers with a plurality of chambers or fields because each chamber or field may have its own heat exchanger section forming part of the fourth heat exchanger, whereby the individual heat exchangers are connected in parallel with one another and through the second heat carrier circuit to the third heat exchanger. Thus, the heat carrier medium receiving its heat in the third heat exchanger, flows through all the individual heat exchangers forming the fourth heat exchanger. The capital investment for such individual fourth heat exchangers is smaller than would be required for equipment capable of supplying the treatment medium, namely the fresh air to central heat exchangers.

According to the invention at least a portion of the sensible heat and the latent remainder heat which may be present in the form of a water vapor, are also utilized before the cleaned exhaust gases are discharged to the atmosphere. The utilized portion of the sensible heat and the latent remainder heat may be used, for example, to heat a heat carrier medium such as water.

BRIEF DESCRIPTION OF THE DRAWINGS

In order that the invention may be clearly understood, it will now be described, by way of example, with reference to the single FIGURE which shows a circuit block diagram of a heat exchanger system that may be used for performing the present method.

DETAILED DESCRIPTION OF A PREFERRED EXAMPLE EMBODIMENT AND OF THE BEST MODE OF THE INVENTION

The heat treatment apparatus 1 may, for example, be a dryer or a tentering frame device. Fresh air is introduced through an inlet 1' of a heat exchanger 20. Used air or exhaust air is discharged through an exhaust air duct 2 leading through a flow control flap 3 to a fluid conveying pump 4. The outlet of the pump 4 leads into a first heat exchanger 5 having an outlet duct 6 connected to a thermal after-burner 7 operating at a temperature of about 750° C. for oxidizing or burning the exhaust gas components of the discharge air to thereby clean the exhaust gas. An outlet duct 8 of the afterburner 7 is connected through a bypass duct 11 and through a flow control flap 12 to an input of a second heat exchanger 13. A portion of the cleaned exhaust gas is diverted through a feedback duct 9 to an inlet of the first heat exchanger 5 for preheating the exhaust gas to be cleaned coming from the duct 2 and to be supplied in a preheated condition to the afterburner 7.

The temperature of the preheated exhaust gas flow to be cleaned can be controlled by conrolling the flap 12 in the bypass duct 11. This control flap 12 controls the proportion of cleaned exhaust gas through the bypass 12 and thus also the proportion through the feedback duct 9 for controlling the temperature in the heat exchanger 5.

A discharge duct 10 connects an outlet of the first heat exchanger 5 to a second heat exchanger 13 which is also connected to the bypass duct 11 through the flow control flap 12. Thus, a cleaned portion of the exhaust gas coming through the duct 9 and through the heat exchanger 5 as well as through the duct 10 reaches the second heat exchanger 13. An outlet of the second heat exchanger 13 is connected through a duct 14 to the treatment apparatus 1, an output of which is connected through a return conduit 14' and a flow control such as a pump 14'' back to the second heat exchanger 13. Thus, the ducts 14 and 14' form a first closed circulating circuit for a heat carrier medium. Further, the second heat exchanger 13 booster heats the heat carrier medium passing through the treatment apparatus 1.

According to the invention an outlet duct 15 of the second heat exchanger 13 supplies the exhaust gas from the second heat exchanger 13 into a third heat exchanger 16 which is connected in a closed circuit flow formed by conduits 17 and 17' to a fourth heat exchanger 20 forming part of the treatment apparatus 1. A flow control such as a pump 17'' is located in the return duct 17' from the fourth heat exchanger 20 to the third heat exchanger 16. Thus, fresh air supplied through the inlet 1' into the fourth heat exchanger 20 is further heated by the heat carrier medium in the closed circuit 17, 17'.

An outlet channel 18 of the third heat exchanger 16 is connected to a chimney flue 19 which discharges the cleaned exhaust gas to the atmosphere after any sensible heat and latent remainder heat has been utilized by heat exchangers, for example, connected to the duct 18 for applying such remaining sensible heat and latent remainder heat to a medium to be heated, such as utility water.

The ducts 14 and 14', as well as 17 and 17', in a system according to the invention can have a relatively small cross-section since they carry only a heat carrier medium such as thermal oil, steam, or the like. Accordingly, the costs for insulating the small diameter ducts is respectively small as compared to conventional ducts which must carry the treatment medium or the exhaust gas.

Although the invention has been described with reference to specific example embodiments, it will be appreciated that it is intended to cover all modifications and equivalents within the scope of the appended claims.

What we claim is:

1. A method for the thermal cleaning of exhaust gases coming from a heat treatment apparatus operated by a gaseous treatment medium, comprising the following steps:

(a) guiding said exhaust gases to be cleaned through a first heat exchanger (5) into an oxidizing device (7) for oxidizing combustible components of the exhaust gases in said oxidizing device (7), (b) returning at least a portion of already cleaned exhaust gas from said oxidizing device (7) to said first heat exchanger (5) for preheating gases to be oxidized and thereby cleaned, in said first heat exchanger (5), (c) guiding cleaned exhaust gas leaving the first heat exchanger (5) through a second heat exchanger (13) for heating a heat carrier medium in a first heat carrier circuit (14, 14') connecting said second heat exchanger (13) to heat exchanger means installed in said heat treatment apparatus (1), (d) supplying gases leaving said second heat exchanger (13) to a third heat exchanger (16) for heating a heat carrier medium in a second heat carrier circuit (17, 17') connecting the third heat exchanger (16) with a fourth heat exchanger (20) located at an entrance of said heat treatment apparatus (1) and preheating in said fourth heat exchanger (20) fresh treatment medium to be freshly supplied into said heat treatment apparatus (1), whereby reusing of any exhaust gas for treatment purposes in said treatment apparatus is avoided.

2. The method of claim 1, in a dryer apparatus having several sequentially arranged treatment chambers forming said heat treatment apparatus, comprising dividing said fourth heat exchanger (20) for preheating fresh treatment medium, into a plurality of heat exchanger sections so that each treatment chamber has its own heat exchanger section, connecting said heat exchanger sections in parallel with each other and to said second heat carrier circuit (17, 17'), whereby the flow of fresh treatment medium to be newly supplied to each chamber is preheated by said heat carrier flowing through said second heat carrier circuit (17, 17').

3. The method of claim 1, further comprising extracting from said cleaned exhaust gases before they are discharged to the atmosphere downstream of said third heat exchanger (16), at least a portion of their sensible heat and their latent remainder heat for heating a medium to be heated, such as water.

4. The method of claim 1, further comprising directly supplying to said second heat exchanger (13) also a portion of already cleaned gas from said oxidizing device (7).

5. A method for the thermal cleaning of exhaust gases coming from a heat treatment apparatus operated by a gaseous treatment medium, comprising the following steps:

(a) guiding said exhaust gases to be cleaned through a first heat exchanger and from said first heat exchanger into an oxidizing device for oxidizing combustible components of the exhaust gases in said oxidizing device, (b) returning a first portion of already cleaned exhaust gas from an outlet of said oxidizing device to said first heat exchanger for preheating gases to be cleaned, in said first heat exchanger, (c) guiding cleaned exhaust gas leaving an outlet of the first heat exchanger through a second heat exchanger for heating a heat carrier medium in a first heat carrier circuit connecting said second heat exchanger to heat exchanger means installed in said heat treatment apparatus, (d) connecting a by-pass flow conduit having a flow control means therein between said outlet of said oxidizing device and said outlet of said first heat exchanger and thus in parallel to said first heat exchanger for diverting a second portion of already cleaned exhaust gas through said by-pass flow conduit to said second heat exchanger, (e) controlling a flow quantity of said second portion of already cleaned exhaust gas by said flow control means in said by-pass flow conduit for adjusting said first and second portions of already cleaned exhaust gas relative to each other to control the temperature in said first heat exchanger, and (f) supplyng gases leaving said second heat exchanger to a third heat exchanger for heating a heat carrier medium in a second heat carrier circuit connecting the third heat exchanger with a fourth heat exchanger in said heat treatment apparatus for preheating fresh treatment medium to be freshly supplied into said heat treatment apparatus.

* * * * *